US005530431A

United States Patent [19]

Wingard

[11] Patent Number: 5,530,431

[45] Date of Patent: Jun. 25, 1996

[54] ANTI-THEFT DEVICE FOR PROTECTING ELECTRONIC EQUIPMENT

[76] Inventor: Peter F. Wingard, 216 Heatherdown Rd., Decatur, Ga. 30030

[21] Appl. No.: 420,019

[22] Filed: Apr. 11, 1995

[51] Int. Cl.[6] ..... G08B 13/22

[52] U.S. Cl. ..... 340/568; 340/539; 340/540; 340/691; 340/825.34

[58] Field of Search ..... 340/568, 540, 340/691, 539, 825.76, 825.72, 825.34, 825.3, 538

[56] References Cited

U.S. PATENT DOCUMENTS

| | | | |
|---|---|---|---|
| 4,390,868 | 6/1983 | Garwin | 340/568 |
| 4,494,114 | 1/1985 | Kaish | 340/825.31 |
| 4,584,570 | 4/1986 | Dotson | 340/568 |
| 4,680,574 | 7/1987 | Ruffner | 340/571 |
| 4,686,514 | 8/1987 | Liptak, Jr. et al. | 340/571 |
| 4,791,409 | 12/1988 | Reid | 340/539 |
| 4,987,406 | 1/1991 | Reid | 340/539 |
| 5,021,779 | 6/1991 | Bisak | 340/538 |
| 5,034,723 | 7/1991 | Maman | 340/568 |
| 5,059,948 | 10/1991 | Desmeules | 340/568 |
| 5,231,375 | 7/1993 | Sanders et al. | 340/568 |

*Primary Examiner*—Glen Swann

*Attorney, Agent, or Firm*—Ralph H. Dougherty; Scott E. Hanf

[57] ABSTRACT

Security (e.g., theft-disincentive) for portable electronic appliances is provided by integrating a decoder into the power supply of an electronic appliance which prevents the electronic appliance from being powered up in the absence of a unique code impressed by an emitter on the power lines feeding power to the electronic appliance, and permits the electronic appliance having a decoder to be powered up (i.e., power-uppable) only in the presence of the unique code. Electronic appliances having the detector incorporated (e.g., integrated) therein are termed "protected equipment". The emitter may be "fixed" by hard-wiring same to the power lines in a household (e.g., behind a switch or receptacle face plate), or may be "portable") so that the user can transport and use (e.g., power up) the protected equipment at an other location simply by plugging the emitter into a receptacle at the other location and located in a safe place. The detector is integrated into the protected equipment in such a manner that bypassing its function (or removing the decoder) will render the equipment inoperable (or, would be cost prohibitive).

34 Claims, 13 Drawing Sheets

*Fig.5a*
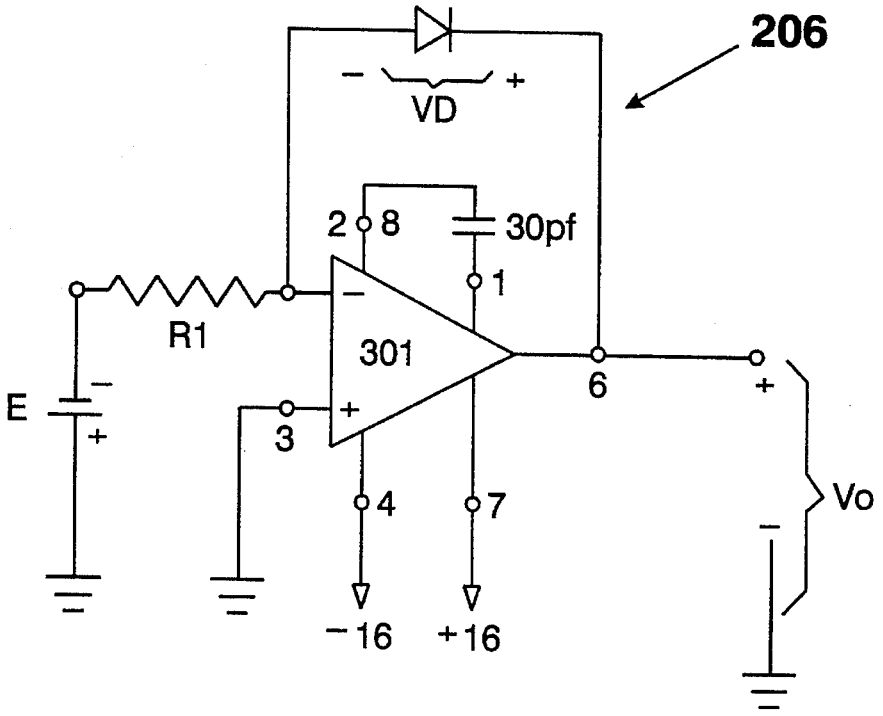
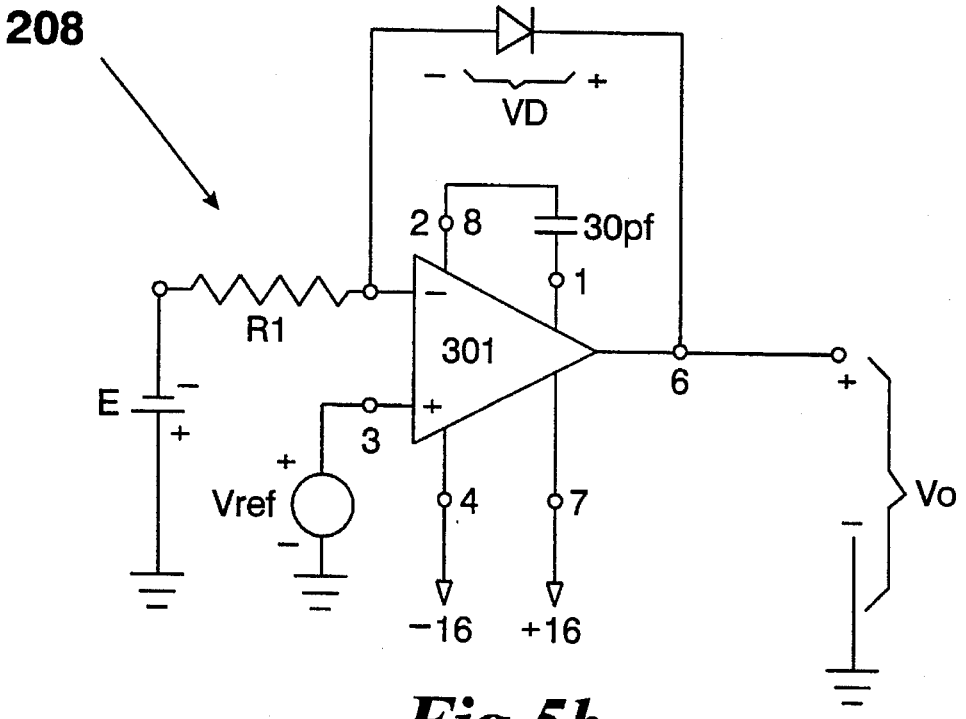
*Fig.5b*

Code Generator

ANTI-THEFT DEVICE FOR PROTECTING ELECTRONIC EQUIPMENT

FIELD OF THE INVENTION

The present invention relates to a method and apparatus for protecting electronic devices (also referred to as electronic appliances or electronic equipment), such as TVs, VCRs, personal computers, stereo equipment, and the like, against theft by rendering the devices inoperative after the occurrence of a disabling event.

BACKGROUND OF THE INVENTION

The miniaturization and ready-availability of electronic devices has resulted in a abundance of small, light-weight, often expensive devices (equipment, appliances) operating off "household" (residential) power (e.g., at 120 VAC). These devices include television sets, stereo equipment, personal computers, and the like. The portability and desirability of such devices make these devices an easy target for theft. The present invention is generally directed to avoiding such theft of such devices. As will be evident, various systems have been implemented which detect movement of a device, and disable the device in one manner or another. Evidently, if the user has an "authorized" (legitimate) purpose for moving (relocating) the device, such systems would be self-defeating.

DESCRIPTION OF THE PRIOR ART

The following patents, incorporated by reference herein, are cited as exemplary of the prior art relating to protecting electronic devices against theft.

| U.S. Pat. No. | Inventor | Issue Date | Title |
|---|---|---|---|
| 4,390,868 | Garwin | 06/28/1983 | SECURITY OF MANUFACTURED APPARATUS |
| 4,584,570 | Dotson | 04/22/1986 | ELECTRICAL APPLIANCE PLUG REMOVAL ALARM |
| 4,680,574 | Ruffner | 07/14/1987 | APPLIANCE ANTI-THEFT CIRCUITRY |
| 4,494,114 | Kaish | 01/15/1985 | SECURITY ARRANGEMENT FOR AND METHOD OF RENDERING MICROPROCESSOR CONTROLLED ELECTRONIC EQUIPMENT INOPERATIVE AFTER OCCURRENCE OF DISABLING EVENT |
| 5,231,375 | Sanders et al | 07/27/1993 | APPARATUS AND METHOD FOR DETECTING THEFT OF ELECTRONIC EQUIPMENT |
| 4,686,514 | Liptak, Jr. | 08/11/1994 | ALARM SYSTEM FOR COMPUTERS AND THE LIKE |
| 5,059,948 | Desmeules | 10/22/1991 | ANTI-THEFT SECURITY DEVICE AND ALARM |
| 5,034,723 | Maman | 07/23/1991 | SECURITY CABLE AND SYSTEM FOR PROTECTING ELECTRONIC EQUIPMENT |

Garwin (U.S. Pat. No. 4,390,868) discloses a design that reduces the motivation for theft by partitioning the design of the manufactured apparatus so as to provide a component essential to the operation that is destroyed both in function and appearance on moving the apparatus.

Dotson (U.S. Pat. No. 4,584,570) discloses apparatus having a small disc placed between an appliance's electrical plug and the outlet, which, if removed, will cause the circuit breaker in the circuit feeding that outlet to blow and an alarm to sound.

Ruffner (U.S. Pat. No. 4,680,574) discloses using time-domain reflectrometry to obtain a measure of the length of wire that connects an electrical appliance to its power distribution panel. An unauthorized change of the length of wire is interpreted as an attempt to steal the appliance.

Kaish (U.S. Pat. No. 4,494,114) discloses a lock-out security arrangement for microprocessor-controlled electronic equipment, wherein the equipment operates "normally" until the occurrence of a disabling event, such as physical removal of the equipment from its "normal" installation and disconnection from a source of electrical power. The equipment is maintained in a disabled state until a code manually entered via a keyboard associated with a microprocessor for controlling the normal operation of the equipment matches a private access code stored (i.e., in non-volatile memory) in the equipment. This patent is incorporated by reference herein.

Sanders, et al. (U.S. Pat. No. 5,231,375) discloses a theft deterrent unit that monitors signal currents transmitted between interconnected electronic units.

Liptak, Jr., et al. (U.S. Pat. No. 4,686,514) discloses a motion sensing circuit, connected to a computerized apparatus, which contains a capacitor in parallel with a mercury switch, that will energize an alarm by closing and switching an electronic 'valve' to a conducting mode, upon sensing movement of the apparatus.

Desmeules (U.S. Pat. No. 5,059,948) discloses an anti-theft security device and alarm for detection of the disconnection of electronic equipment from a series electronic signal path loop between the chassis of the equipment and ground.

Maman (U.S. Pat. No. 5,034,723) discloses a cable which provides power to electrical equipment, but also acts as a security device when the "state" of the cable is communicated as "removed" by the repair AC power lines, said power lines being connected to a central station.

As used herein, "protected" equipment (or appliance, or device) is an item of electronic equipment (or appliance, or device) that is protected, in one way or another, against theft. As is evident from the references cited hereinabove, prior art techniques for protecting electronic equipment against theft generally do not address portability (authorized removal from one location and re-installation at another location) without cumbersome intermediaries such as keying in a code in a microprocessor-based device (see, e.g., Kaish) and/or causing undue expense (which is an inherent feature of many of the above-described techniques, to deter theft of the equipment). In some of the techniques described above, the protected equipment will be rendered inoperative by a power outage, causing the authorized user of the protected equipment to perform complicated steps to restore normal operation of the protected equipment.

SUMMARY OF THE INVENTION

The invention provides a detector incorporated into the power supply of electronic equipment to protect against powering up the electronic equipment in the absence of (and, conversely, permits powering up only in the presence of) a unique code provided by an emitter impressing a unique code on the power line from which the electronic equipment derives its power.

According to an aspect of the present invention, a single "emitter" (also referred to as "encoder") and power key is provided which produces and transmits a unique code to one or more items of electronic equipment, and a "detector" (also referred to as "decoder" or "power lock") is incorporated into the power supply unit of each item of electronic equipment which disables operation of the equipment if the unique code is not detected upon attempted power up of the equipment. The emitter and detector work in concert, as key and lock, to prevent unauthorized use of the protected equipment.

The concept underlying this invention is to deter thieves from stealing valuable home electronic equipment. This is generally accomplished by rendering the protected appliance inoperable after it is removed from its source of power, for example, if a thief steals a TV set. The crux of this device's effectiveness is the fact that, in order to steal any electronic equipment, it must be removed (i.e., unplugged) from its power source (e.g., the wall plug of a home). The unplugging of the protected equipment is perceived as a disabling event. If unplugged, a circuit designed to detect a loss of power will render the protected equipment inoperative, and will allow the protected equipment to operate only when an appropriately encoded emitter provides a unique code over the power lines into which the protected equipment is re-plugged. The unique code will be received by the protected appliance's detector via the power conductors of the house's electrical wiring. If the proper code is received, the detector will then allow the protected appliance to be powered up.

It should be understood that, although the present invention is described principally in the context of transmitting (and receiving) the code over household wiring, the codes could be transmitted (and received) wirelessly (via a short-range RF signal), although this is not preferred. In such a case, the emitter would be a "transmitter" and the detector would be a "receiver".

According to an aspect of the invention, protected equipment is provided with readily discernable markings to indicate their unique, protected nature. These markings can take the form of a red stripe on the power cord, or other suitable (including text and/or symbolic) marking. When a thief discerns such a marking, the motivation to steal the protected appliance will greatly be attenuated by the fact that it cannot be used without the appropriately-encoded emitter (power key). Needless to say the user should ensure that the emitter is kept in a not readily accessible or, at least, secure location.

There are two principal embodiments of the invention: (a) a "portable" embodiment, and (b) a "fixed" embodiment. The main difference between these two embodiments is whether or not the emitter is a permanent fixture of the house (hence, not readily transported by the user) or is portable (hence, readily transported by the user, typically in conjunction with authorized relocation of the protected equipment. In both embodiments, the detector is an integral part of the electronic appliance being protected. The detector is preferably an integral part of the power supply of the electronic appliance, incorporated into the electronic appliance during its manufacture, and is not easily separated from the electronic appliance without damaging or destroying the protected electronic appliance. The detector is preferably incorporated into the protected appliance in such a manner that bypassing same, or removing same would be difficult without rendering the appliance permanently inoperative. For example, the detector can be incorporated directly into a printed circuit board of a power supply for the protected equipment.

In the "portable" embodiment, the emitter contains all the circuitry necessary to perform its function. This emitter is readily constructed in a small size, such as would fit in the palm of a user's (human) hand. The emitter is plugged into any electrical receptacle of the home where it is desired to operate the protected equipment. The detector, as stated previously, is integrated into the protected equipment.

In one embodiment of the portable embodiment of the invention, the factory codes are unique to the item of protected equipment and are fixed (not alterable). The emitter is supplied with the protected equipment and, when plugged by the user into the same power source (e.g., household wiring) as the protected equipment, permits the protected equipment to power up.

In the "fixed" embodiment, an emitter personalized with a unique code is "hard wired" to the household power wiring. It may be mounted (and connected to the wiring) at the power meter (and may be an integral component of a power meter), or at the fuse (breaker) box (power panel), or may be sized so as to fit behind a face plate of a receptacle or light switch where it will not readily be located. In this scenario, when an authorized user purchases protected equipment, the protected equipment comes supplied with a temporary key, which is essentially a portable emitter with a unique, "factory" (pre-set) code matching a pre-set (initial) code in the detector of the protected equipment. However, in this scenario, after inserting the temporary key, upon powering up, the protected equipment "looks for" the (personalized) code to be impressed on the power lines by the fixed emitter. Upon "finding" the code, the protected equipment "mates" itself to the emitter's unique code and stores the code, thereby personalizing the protected equipment. Each time the protected equipment is powered up, it will first look again for the unique code on the power lines as a condition precedent to operating. In the event of a power outage, the protected equipment does not "forget" the code, and need not be re-initialized by the authorized user (key-holder). A benefit of the fixed emitter scenario is that the fixed emitter will supply the proper code automatically if power is lost (i.e., upon restoration of power), thereby eliminating the need to re-key all protected equipment manually. If the protected equipment is sold, the owner will supply the temporary key to allow the unit to remate itself to its new location or simply operate as in the first (portable) scenario (where the user simply plugs in the key whenever there is a need to reactivate the device).

Generally, the unique code (especially the factory code) is selected from a large combinations of codes, making it impractical for a thief to operate the protected equipment simply by trying a large number of codes. This may suitably be implemented by incorporating a "lockout" feature on the detector, which will permanently disable the detector upon the receipt of three incorrect codes in a given time interval (e.g., one minute). A locked-out item of protected equipment would be taken by the user to the dealer (authorized factory representative) to restore its ability to function. The portability of the protected equipment, making it attractive to steal, would be of benefit in such a situation.

There are a number of ways in which the present invention can be employed, including:

(1) Fixed emitter, whether permanently plugged in a power outlet or hard wired somewhere behind a faceplate or in the power distribution panel or power meter, but still localized to the residential unit. Under this condition, the internal code needed to permit operation of the protected equipment will automatically be supplied by the fixed emitter to the detector in the protected equipment by transmission via the household power wiring.

(2) Fixed emitter, hard wired as in (1), but accessible to the authorized user. In this embodiment the code is provided by the user by inserting a key that transmits (broadcasts within the range of the protected equipment) the unique code via the hard-wired emitter. The user-selectable code can be keyed into the emitter via optical, mechanical, or electromagnetic means (requiring a reading device in the fixed emitter) so that the user-selected code is impressed onto the power lines to which the emitter is connected. In other words, in the first case (1) the emitter has internal code and in the second case (2) the emitter has external code input from a reading device, which may be internal to the emitter or supplied as an external component which may be plugged into the emitter.

(3) Non-fixed (or able to be stored away safely) emitter (power key) that is plugged in a power receptacle to transmit its internal code to the detector via residential power conductors when necessary.

(4) Emitter hard wired directly to or plugged directly into the protected device. This would allow the power key to be inserted directly into the unit somehow or the key (or card) carrying the code to be inserted into the emitter mounted or inserted directly in the unit and then transmit a code directly to the detector. In other words, the code is not transmitted from a physically separate emitter device via wiring or other medium. The power key is insertable into the transmitter for providing the unique code. This transmitter may be either hard-wired or plugged into the electronic equipment.

(5) Fixed emitter (as in (2)) that transmits the code via short range RF (radio frequency signal) and does not use the household wiring.

(6) A public utility such as the power company or phone company that supplies the emitter code to the protected units as part of a universal service arrangement between the utility industry and the home electronics industry. Specifically, the consumer would buy protected devices (with detectors) that would automatically "latch on" to a unique residential service code provided by the utility companies for individual addresses or units. This is the same as (1) except in this scenario the user does not have to supply a fixed emitter.

(7) Scenarios where a single emitter (in any aforementioned embodiment) is capable of unlocking multiple protected units. This would include schemes that allow different detectors to "learn" a temporary code (from a universal emitter) and thus all protected units could be restored by a single emitter or emission (so long as the permanent key supplied with the unit is available for input to allow the learning of any new or temporary codes).

(8) Any combination of the above ((1)–(7)).

OBJECTS OF THE INVENTION

It is an object of the invention to provide an improved technique deterring theft of electronic equipment.

It is another object of the invention to provide a system for securing (deterring theft of) electronic equipment that is suitable to home (versus commercial) use, principally in the low cost and ease of use of such a system.

It is another object of the invention to provide a technique for protecting electronic equipment against theft, while allowing the authorized user to relocate the electronic equipment.

It is another object of the present invention to provide a technique for protecting electronic equipment that requires little or no effort on the part of the authorized user to restore the functionality of the protected equipment after a power outage.

Other objects, features and advantages of the invention will become apparent in light of the following description thereof.

BRIEF DESCRIPTION OF THE DRAWINGS

The foregoing and other objects will become more readily apparent by referring to the following detailed description and the appended drawings in which:

FIGS. 5A–5D are detailed schematics of four of the components (the Vo Sensor 206, the Vth Sensor 208, the VRD Logic 210, and the Code Generator 212) of the emitter of FIGS. 2A–2C, according to the present invention.

DETAILED DESCRIPTION OF THE INVENTION

Figure 1:
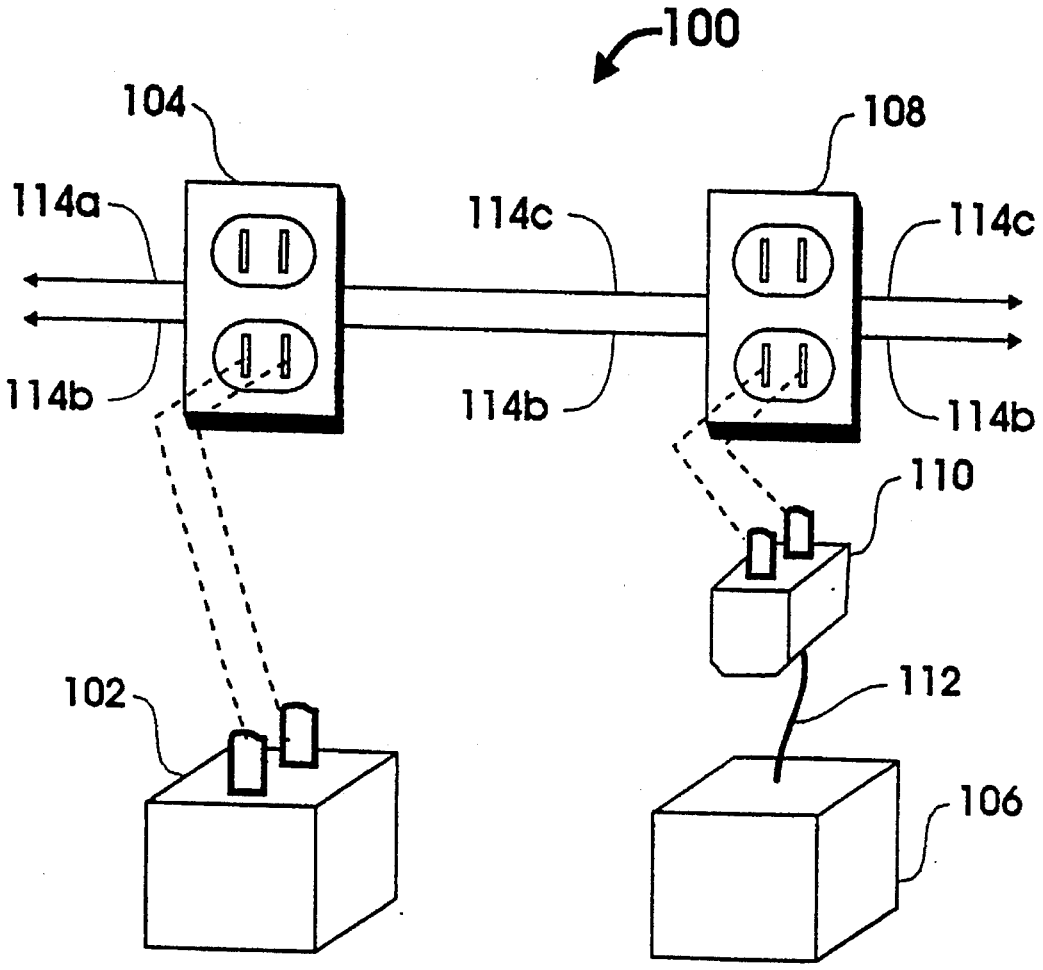
FIG. 1 is a generalized isometric view of an embodiment of the invention.

FIG. 1 shows a generalized, illustrative embodiment of a system 100 for providing protection against theft of an item of electronic equipment (appliance), such as a TV, a VCR or the like. An emitter 102 is plugged into (dashed lines) a receptacle 104, and an item of electronic equipment 106 is plugged into a receptacle 108 via a plug 110 and a cord 112. The receptacles are wired in a normal manner to the two conductors of household wiring (e.g., 120 VAC). To the left side of the figure, the household wiring is shown as two conductors 114*a* and 114*b*, and would be attached through a fuse box (power panel) to a power meter. As explained in greater detail hereinbelow, the emitter 102 impresses a coded signal onto the household wiring such that wiring within the household, to which appliances are connected, is denoted by two wires 114*c* (signal-encoded version of 114*a*) and 114*b*.

Generally, there is a strong incentive for a thief to unplug such equipment, and steal it. In order to deter an incentive to such theft, the equipment 106 is provided with a detector (or "decoder"; described in greater detail hereinbelow), which will prevent usage of the equipment 106 in the absence of the emitter 102 impressing a unique code on the lines 114*c* and 114*b* from which the equipment 106 derives its power. In this embodiment, the emitter 102 is small and portable, and is suitable to be plugged into any other receptacle on the same circuit (i.e., on the same lines 114*c* and 114*b*) as the receptacle 108 into which the appliance 106 is plugged.

As is evident from the embodiment shown in FIG. 1, the emitter 102 may be very compact. Of course, if the thief were to steal the emitter, as well as the appliance, the appliance would be operable at another site. To avoid this eventuality, it is preferred that the emitter be installed in a secure location and/or not be readily taken by a thief. For example, in a "fixed" mode, the emitter can be "hard-wired" into the fuse (breaker) box of the household, entirely out of sight. An alternative in the fixed mode is to install the emitter behind a faceplate of a receptacle or a light switch, in either case hard-wiring the emitter to the household wiring. In a "portable" mode, the emitter is preferably provided with prongs (as shown in FIG. 1) for plugging the emitter into any wiring system from which the protected appliance is drawing its power.

Generally, the protected appliance becomes inoperable upon a power interruption (e.g., unplugging the protected unit, or a power outage), until its ability to operate is restored by the power key.

Generally, in all of the embodiments described hereinbelow, include the emitter detector relationship (power key and power lock) that requires transmission of a code (not required to be known by the user) from the emitter to the detector that allows the protected unit to operate after a power disruption occurs. The detector is always a fixed part of the unit being protected and requires no knowledge of it or interaction with it from the user. The variations occur from whether the emitter is portable or fixed, whether the code transmission is initiated by the user or automatically sent by the emitter after a disruption, whether the emitter communicates indirectly or directly with the detector and the medium in which the indirect communication occurs, whether the code is stored internally or externally from the emitter, and whether the emitter is localized to the individual user or supplied by an outside public utility or private agency. To claim discontinuance of the power supplied to the protected unit when its source is disrupted (locked) and then to be restored (unlocked) by the following methods or embodiments: (1–8)

Figure 2A:
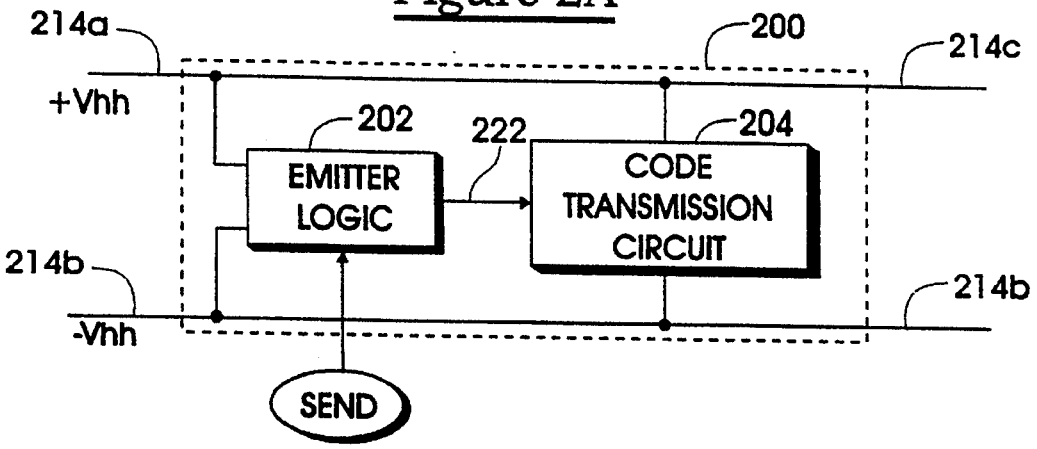
FIG. 2*a* is a functional block diagram of circuitry for an emitter, according to the present invention.
Figure 2B:
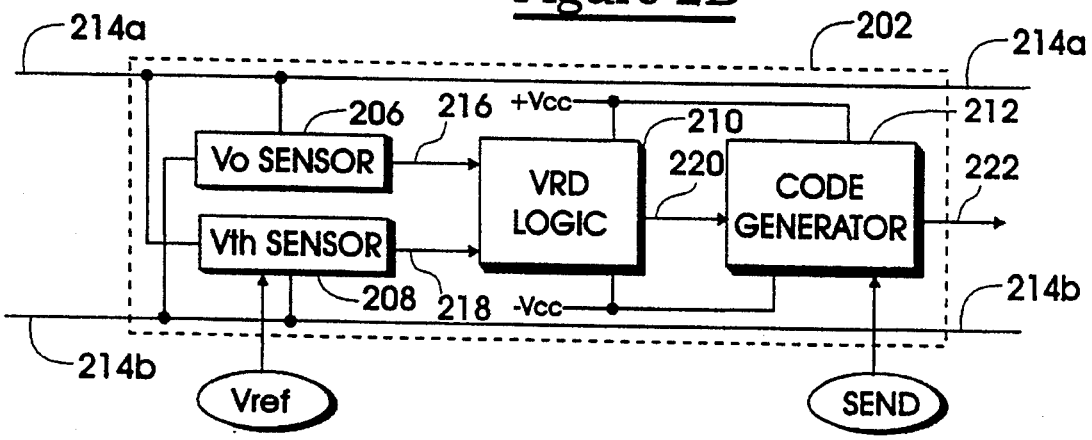
Figure 2C:
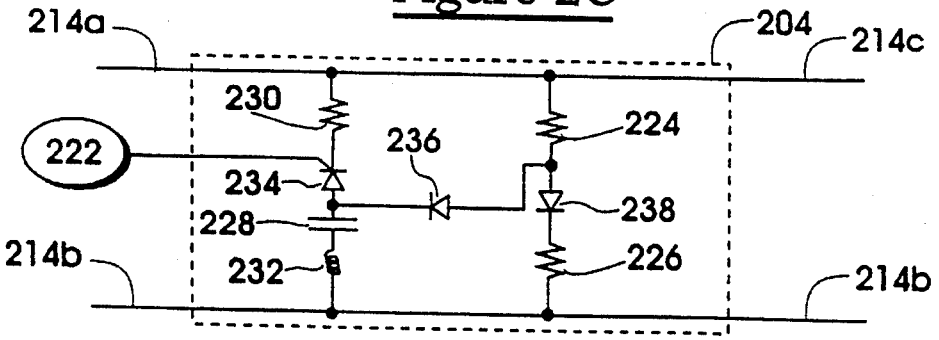

FIGS. 2A–2C are related to the circuitry of a portable emitter.

As shown in FIG. 2A, the emitter 200 (compare 102) has two main components: (1) emitter logic 202, which provides the intelligence or control of the emitter output and is primarily digital in make-up; and (2) Code Transmission Circuit (CTC) 204, which does the actual signaling and is non-digital or analog. The emitter 200 (compare 102 of FIG. 1) is shown connected to two conductors of household wiring. As in FIG. 1, the "street-side" of the wiring is two conductors 214*a* (compare 114*a*) and 214*b* (compare 114*b*), and the "house-side" of the wiring is two conductors 214*c* (compare 114*c*) and 214*b* (compare 114*b*). For purposes of the discussion that follows, it is deemed that the conductor 214*a*, upon which a signal will be impressed by the emitter is at a potential of +Vhh ("hh"=household), and the conductor 214*b* is at a potential of −Vhh (it being clearly understood, however, that household current is alternating current). For purposes of this discussion, the household wiring is considered to be an "external power source". The emitter will impress a unique code signal on one of the household conductors (214*a*), resulting in an encoded output on a line 214*c*, in response to the user providing a send (SEND) signal (e.g., via a push button, not shown).

As shown in FIG. 2B, the emitter logic 202 comprises two voltage sensors 206 and 208 comprising a voltage sensor circuit, a Voltage Range Detector (VRD) 210, and a Code Generator 212.

Each voltage sensor circuit (206, 208) preferably comprises of an operational amplifier, and the voltage sensor circuits provide digital level inputs to the VRD circuit 210. For example, the Vo Sensor 206 provides a logic '1' signal to the Voltage Range Detector 210 when the household voltage (on lines 214*a* and 214*b*) is below the 0 voltage level. The Vth sensor 208 provides a logic '1' signal to the Voltage Range Detector 210 whenever the household voltage is below a reference level (Vref), which is set, for example, between +5 and +10 Volts. Each voltage sensor 206 and 208 provides its respective signal to the Voltage Range Detector 210 over lines 216 and 218, respectively. These inputs (on lines 216 and 218) to the Voltage Range Detector 210 will result in the Voltage Range Detector 210 outputting a clocking signal on a line 220 which is representative of the line frequency (typically 60 cycles per second, or Hertz) of the household voltage on the power lines 214*a* and 214*b*. This clocking signal on the line 220, when combined with a user input signal (SEND) to send or transmit, will be what triggers the Code Generator 212 to output its internal code. This "timing scheme" purposefully synchronizes the Code Generator 212 to impress the unique code signal onto the power lines 214*a* and 214*b* only when the household voltage is near 0 volts, at its positive-to-negative transition and, as described below, only when the user initiates transmission of the code by a send signal (SEND). This synchronized (with zero-crossings of the household voltage) operation is preferable, for the following reasons:

(1) It allows signaling to be done during "quiet" times, therefore requiring less power for the code signal to propagate over the power lines.

(2) The generated (code) signal would be less likely to damage equipment without synchronization. Generally, the code signal (nominally 10 volts) could be additive with the household voltage (nominally 120 volts), and 130 volts may be sufficient to damage equipment.

(3) Since household current is typically in-phase (or nearly in-phase) with its voltage, during these "quiet" windows the current should not cause problems while transmitting the "weaker" code signals.

(4) Preferably, in the case of impressing a "positive" code signal on the lines 214*a* (214*c*) and 214*b*, the "window" during which the code is transmitted over the lines (onto the lines 214*c* and 214*b*) is synchronized with the positive-to-negative transition of the line voltage. In other words, the sense of the transition determining the window should be opposite to the sense of the code signal. Generally, a positive sense code signal will be more readily discerned by the detector than a negative sense code signal on the positive to negative transition. Signal is more easily seen on positive to negative transition than on negative to positive transition.

As discussed hereinabove, the Voltage Range Detector 210 provides a "windowing" signal on the line 220 as an input to the Code Generator 212. Another input in conjunction with this signal (labelled "SEND", shown in FIGS. 2A and 2B) to the Code Generator 212 controls when the Code Generator 212 will provide the unique code on the line 222 to the Code Transmission Circuit 204.

The code can be stored (or set) in the Code Generator 212 by a variety of means, such as EPROM, ROM, PLA, or some other type of permanent yet programmable memory. The particular type of code-storage memory selected will be dictated by cost, and manufacturability of different emitters with different codes. On the other hand, once the code is stored it should not be readily detectable, and should not be easily changed other than by the authorized user. DIP switches, although suitable for storing a code, would not meet all of these requirements.

From the description set forth above, one having ordinary skill in the art to which the invention most nearly pertains would be able to implement the described functions of the described components of the emitter.

At the user's request (SEND), the code is output by the Code Generator 212, over the line 222, to the Code Transmission Circuit 204 which impresses the code onto the power lines (household electrical conductors) 214*a* (214*c*) and 214*b*.

FIG. 2C shows a suitable arrangement for the Code Transmission Circuit 204 which is, essentially, a passive component of the emitter 200. A voltage divider is formed by two resistors 224 and 226 disposed across the power lines 214*a* and 214*b* to charge a capacitor 228 to a fraction of the household voltage. More particularly, by way of example, the resistor 224 has twelve times the resistance of the resistor 226, so that the capacitor 228 is charged to 1/12 (one-twelfth) of the household voltage (Vhh). The household voltage nominally being 120 volts, the capacitor will charge to 10 volts through the resistor 224. The capacitor 228 is connected by a resistor 230 to the line 214*a*, and by an inductor 232 to the line 214*b*. Diodes 234, 236 and 238 are connected, as shown so that only the positive portion of the voltage is "seen" by the RCL network (230, 228, 232). Generally, the capacitor 228 remains in a charged state until the code signal on line 222 is introduced at the gate of SCR 234, at which time the code signal is impressed on the line 214*a* (214*c*), and the capacitor discharges its stored voltage (through gated SCR 234) onto the lines 214*a* (214*c*) and 214*b*. Upon receiving the code signal (222) the RCL network becomes switched (by SCR 234) across the conductors of the household wiring. Since this event is synchronized to when the household voltage (Vhh) is essentially 0, the 10 volts stored on the capacitor 228 is easily seen. The inductor 232 prevents any instantaneous current discharge from the capacitor 228 from damaging any other sensitive electronic devices (not shown) that may be on the power line conductors 214*a* and 214*b*. The actual values for the RCL network will depend on the duty cycle of the gate (of SCR 238), how long and how many times it is open during the signaling period. The RC constant of the capacitor 228 and resistor 230 should be small enough to allow the capacitor 228 to recharge in just one cycle. The RL constant of the resistor 230 and the inductor 232 should be large enough to prevent over-current and the premature discharge of the capacitor 228 before the signal is finished. The inductor 232, however, cannot be so large as to cause excessive arcing when the gate (of SCR 234) attempts to switch off, thus destroying the code signal's clarity. Representative values for R (resistor 230), C (capacitor 228) and L (inductor 232) are: R=2 Ω (ohms); C=200 μF (microFarads); and L=100 mH (milli-Henries).

FIGS. 3A–3E are descriptive of an exemplary embodiment of the detector. Generally, the detector is integrated into the protected appliance's (compare 106 of FIG. 1) power supply 304, which receives its power from household wiring comprising a conductor 214*c* (having an encoded signal, and deemed to be at a potential of +Vhh) and a conductor 214*b* (deemed to be at a potential of −Vhh). The detector consists of a detector circuit 306 itself and Power Flow Circuit (PFC) 308. The Power Flow Circuit 308 is a circuit centered around an SCR 324 that acts as a gate to control power flow to the protected appliance. The Power Flow Circuit 308 receives, as its input, the 'match' signal on line 316 from the from the output a Counter Controller 312 to switch the power (to the functional elements of the protected appliance) from the line 214*e* on and off (connected to, not connected to the line 214*d*).

Figure 3A:
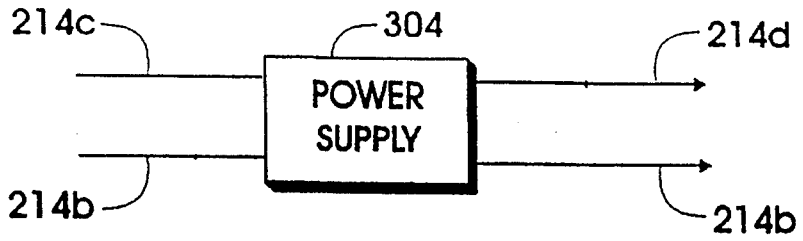
FIGS. 3A–3E are block diagrams of portions of the circuity of an embodiment of a detector, according to the present invention.
Figure 3B:
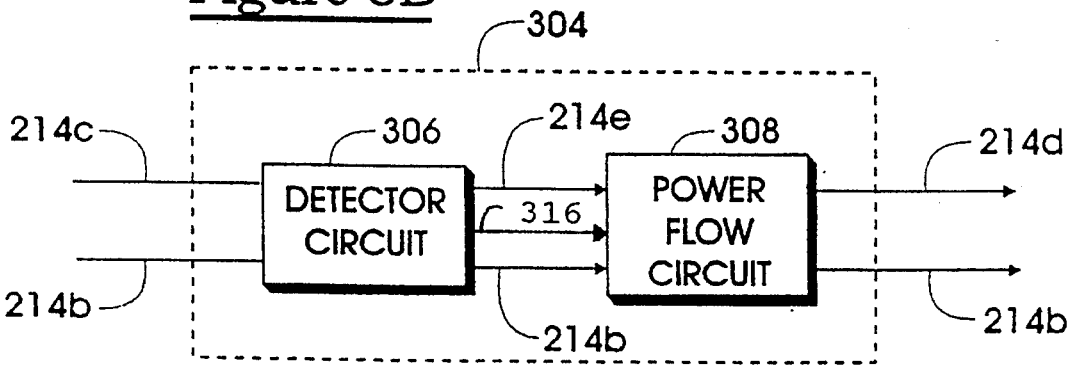
Figure 3C:
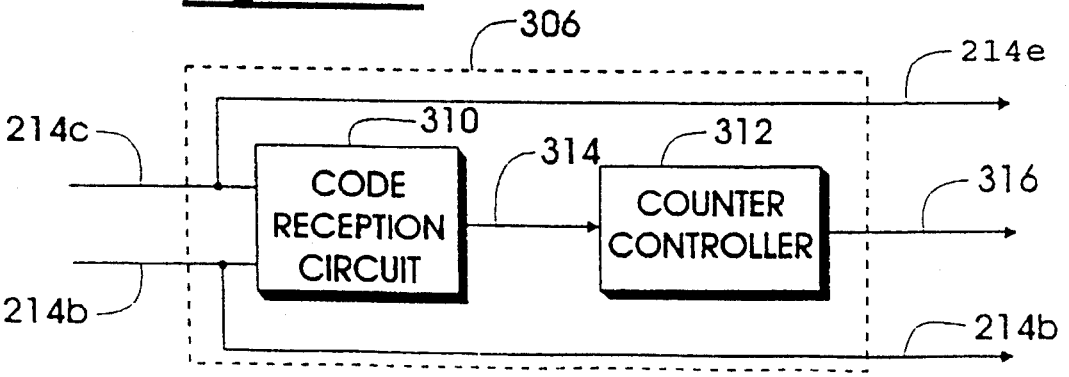

As best viewed in FIG. 3C the detector circuit 306 comprises a Code Reception Circuit 310 and a Counter Controller 312. The Counter Controller outputs a "match" signal on the line 316 to "gate" the SCR 324 (see FIG. 3E).

Figure 3D:
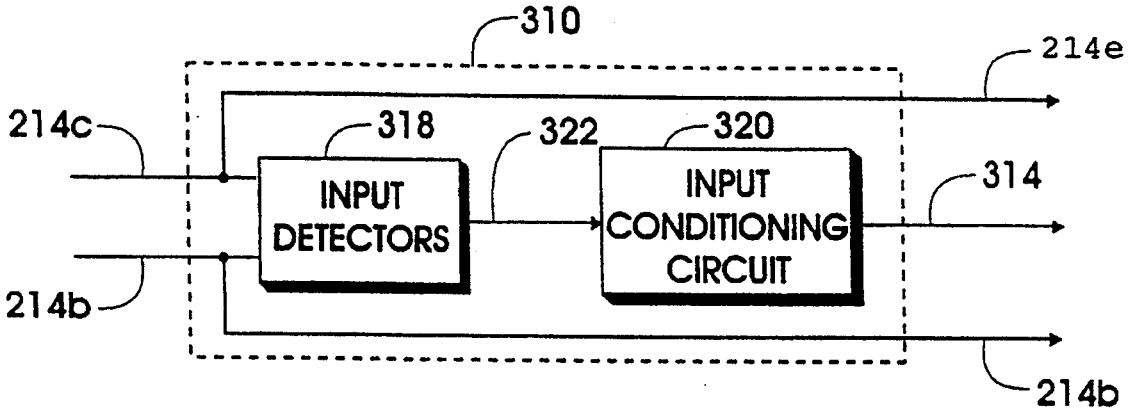
Figure 3E:
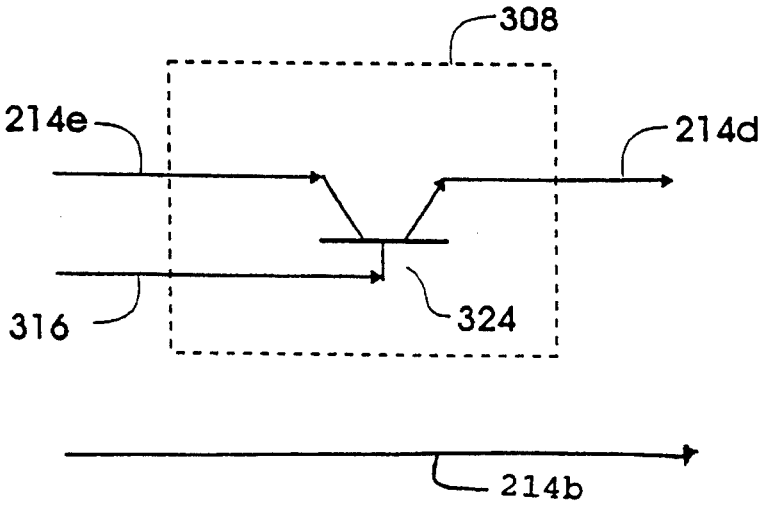

As best viewed in FIG. 3D, the Code Reception Circuit 310 comprises Input Detectors 318 (such as band-pass filters) and an Input Conditioning Circuit 320. The output of the Input Detectors 318, on the line 322, is a input as a raw-wave form signal to the Input Conditioning Circuit 320, which outputs a conditioned (e.g., square wave) signal on the line 314 to the Counter Controller 312 (see FIG. 3C).

The Input Detector 318 is preferably a band-pass filter circuit designed to pass the frequency of the incoming code while eliminating the power frequency and the majority of any noise. Preferably the center frequency would be around 2,500 Hz (for 200 uS pulse lengths). The Input Conditioning Circuit 320 takes the raw input and conditions it to be suitable for digital input into the Counter Controller 312. Basically, the Input Conditioning Circuit 320 takes the top off the raw input signal and squares up its sides by any suitable limiting and buffering circuit. Generally, the filtering and conditioning is based on the signal quality desired on the line 314.

The Counter Controller 312 is the most complex part of either the detector or the emitter, and is described in greater detail hereinbelow (e.g., in FIG. 4). It should be understood that the Counter Controller 312 is preferably implemented in logic, wherein various functional blocks will either "do something" or "not do something" as in "set" or "reset". This should not be inferred to be a 'l' or 'O' or a high or low signal. The actual signal level will be determined by hardware which is chosen to implement the design, and is not critical to an understanding of the design. At times, circuits will be referred to that show these specific states. It should also be understood that all clock transition "actions" referred to, are deemed to be leading edge triggered, although trailing edge actions, or mixed logic, could be employed.

Figure 4:
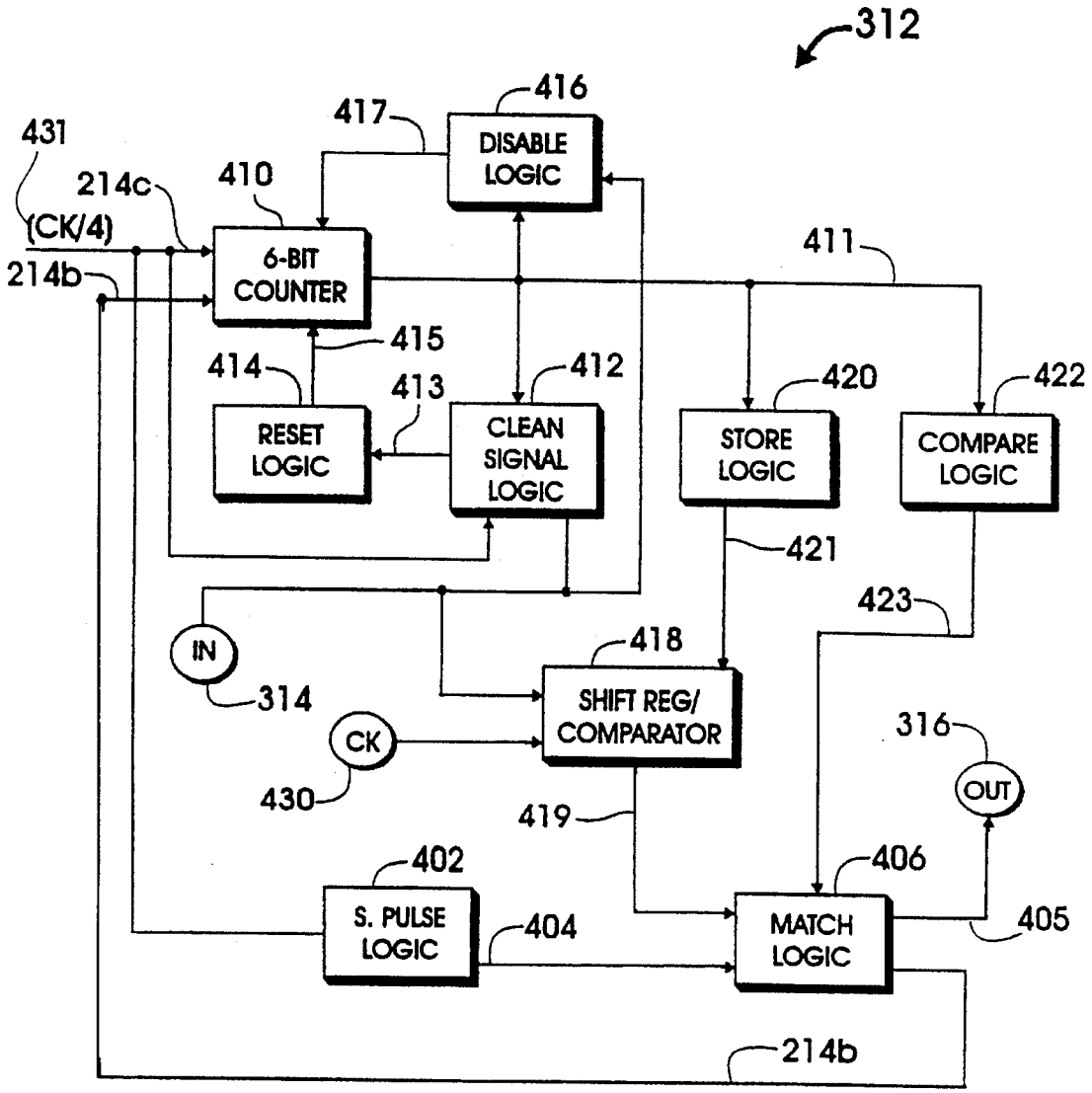
FIG. 4 is a more detailed block diagram of one of the components (the Counter Controller 312) of the detector of FIGS. 3A–3E, according to the present invention.

FIG. 4 is a more detailed description of the Counter Controller Circuit 312 of FIG. 3C. On powering up, (e.g., from a loss of power condition) a single pulser circuit (S. Pulse Logic) 402 will emit a pulse on a line 404 that will reset match logic 406 (such as by resetting a D flip-flop in the match logic). When reset, the match logic 406 emit a logic signal on the line 214*b* that will enable a Counter 410 to begin counting. This same logic condition will disable (turn off) the SCR (324) that allows (when turned on) power to flow to appliance that is being protected, by way of the 'Match' output (OUT) 316 from the counter controller circuit 312. As will be evident, it is only necessary to use the least significant six bits of an 8-bit counter (410) to control the following, exemplary sequence of events (sixty four counter states).

The first two (counter) states, 0 and 1, reset or clear the Clean Signal Logic 412. If any input is later received (a '1' appearing at the input of the detector), the Clean Signal Logic 412 will then be set. The Counter 410 continues counting from state 1 to state 27, regardless of any input. Then at state 28 Reset Logic 414 will reset the Counter 410 back to the 0 state if the Clean Signal Logic 412 has been set in the interim (between states 1 and 28 of the counting process). If the Clean Signal Logic 412 is still clear the Counter 410 will not reset to state 0, but will go on to state 29.

At state 29 the Disable Logic 416 "disables" the Counter 410 from counting until the leading bit of the code signal is received. Once input (IN) 314) begins, the Counter 410 restarts and steps through states 30 to 57. These counter states enable the Shift Register 418 via the Store Logic function 420 . The Shift Register 418 begins storing the input it 'sees' at each of its clock pulses. The Shift Register 418 is operating at a rate that is 4 times slower than the overall counter controller (312) to allow it to simulate the clock rate of the incoming code.

At step 58 the Compare Logic 422 is activated. The output of the Compare Logic 422, on the line 423, such as from a comparator (not shown) within the Shift Register 418, is used as a clock pulse to the D flip-flop in the Match Logic 406. At the moment that the clock pulse is received by the D flip flop, the comparator's output is stored in the D flip-flop of the Match Logic 406. The comparator is continually comparing the stored code (such as is stored in ROM, or by DIP switches, as described hereinabove) to whatever is currently stored in the Shift Register 418. However, only for this one instant does the Match Logic 406 look at that comparison output. If there is a match, the Match Logic 406 will be set. Otherwise, it will remain unset. As stated earlier, if the Match Logic 406 is set the 'match' output will enable the SCR (324) to allow power to flow to the protected appliance, as well as disable the Counter 410 to prevent needless cycling. If there is no match, the Counter 410 will step through the final 5 unused states of the counting sequence before rolling over to the 0 state where this entire process will repeat itself from the beginning.

The Clean Signal Logic 412 forces the detector to require the input line to be "clean" or without input pulses for 28 (0–27) detector clock pulses. This translates to 7 emitter (200) clock pulses or the length of a single transmission of code. The gaps between possible pulses will be much larger than the data windows themselves (10 times or so). The data is synchronized by the VRD Logic 210 of the emitter 200 (202) to be transmitted during the positive to negative transition of the household voltage signal. These are at 1/60 second intervals (20 milliseconds) while the data window is currently designed to be about 3 milliseconds. To wait for a clean signal assures that the first bit detected is in fact the leading bit. It also disables the circuit during noisy intervals. Without this feature, if the device were plugged in long enough on a noisy line the random noise may eventually unlock the device.

Both the emitter and the detector are clocked and are required to function independently, but they are also required to exchange information. To this end, a straightforward technique is provided to properly synchronize their communications. The first bit (e.g., of seven bits) must always be one. The first bit, when received by the detector, will alert the detector to receive the next six bits. Since the following information may be all 'zeros' the detector must look in specified intervals after the first bit and capture whatever information is there. To ensure that the detector catches the first bit in time to react properly, the clock rate (See FIG. 4, CK/4 431) of the detector is designed to operate at a rate of at least two, such as (and preferably) four, times faster than the clock rate ("CK 430") of the emitter and shift register components. If the emitter is transmitting clock pulses 200 μs (microseconds) in length (therefore the code bits will last 200 μs), the detector's pulse lengths will be at least 100 μs (50 μs at four times the clock rate of the emitter). This ensures that the detector will catch the leading bit in the first 25% (e.g., when operating at four times the clock rate of the emitter) of its length. The following "looks" at the data stream can then be calculated to occur midway through the remaining bits (based on design criteria). Since both clocks (sending and receiving) will be running independently, some drift will occur after the initial synchronization. This slow rate/fast rate scheme will allow the actual clock rates to differ up to 8% between them (from design) and the resulting drift will not affect the successful transfer of data. In order to catch the data, however, the shift register (418, FIG. 4) is to be clocked (CK, 430) once for every four pulses of the detector's main clock. This is to simulate the expected clock rate of the incoming data. To maximize resistance to drift, the clock rate for the Shift Register (418) is triggered 90 degrees out of phase from what the detector "believes" to be the phase of the incoming data. This places the triggering edge for the store command of the Shift Register (418) in the middle of the pulses following the leading one. The Compare Logic (422) must also look at the correct clocking segment in which all the information has been received in Qo to Q6 of the shift registers. If the Compare Logic (422) were to make its comparison too soon, it would indicate a mismatch, since all of the code would not yet have been stored. If the Compare Logic (422) were to make its comparison too late, the leading bits of the code would have already been shifted out, and lost (also resulting in a mismatch).

FIG. 5A is a detailed schematic of an exemplary embodiment of the Vo Sensor 206 (of FIG. 2B) employing a "301" operational amplifier.

FIG. 5B is a detailed schematic of an exemplary embodiment of the Vth Sensor 208 (of FIG. 2B) employing a "301" operational amplifier.

Figure 5C:
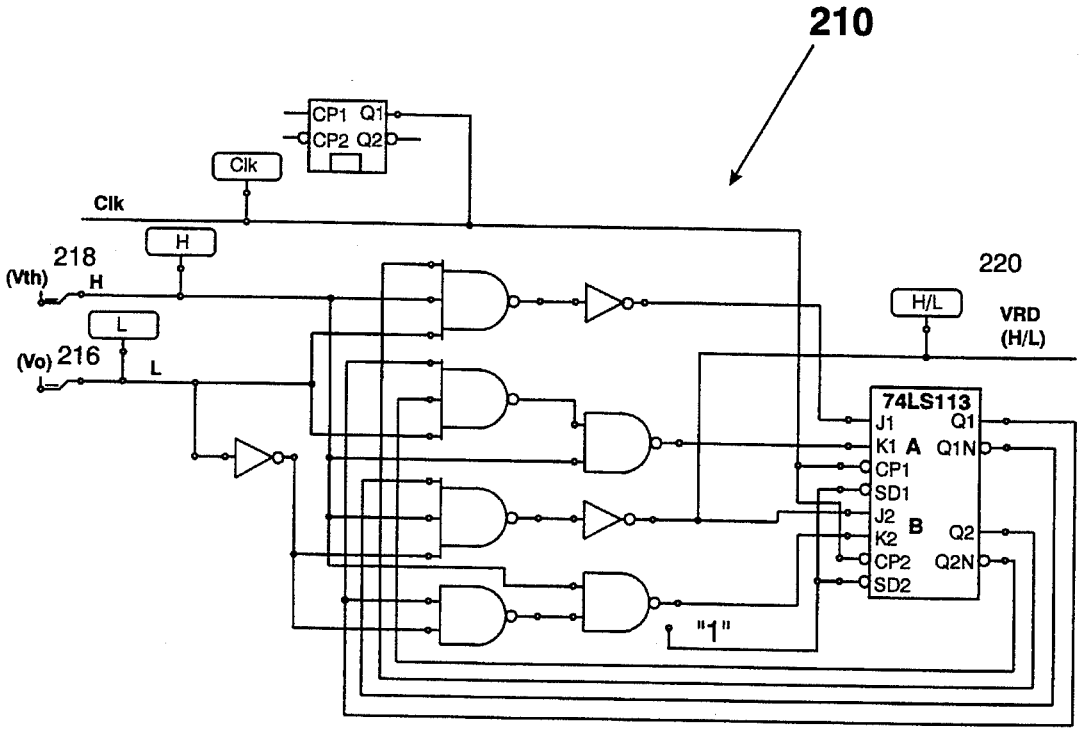

FIG. 5C is a detailed schematic of an exemplary embodiment of the VRD Logic 210 (of FIG. 2B) employing a number of gates and flip-flops, such as a "74LS113" dual J-K negative edge-triggered flip-flop with preset (no clear).

Figure 5D:
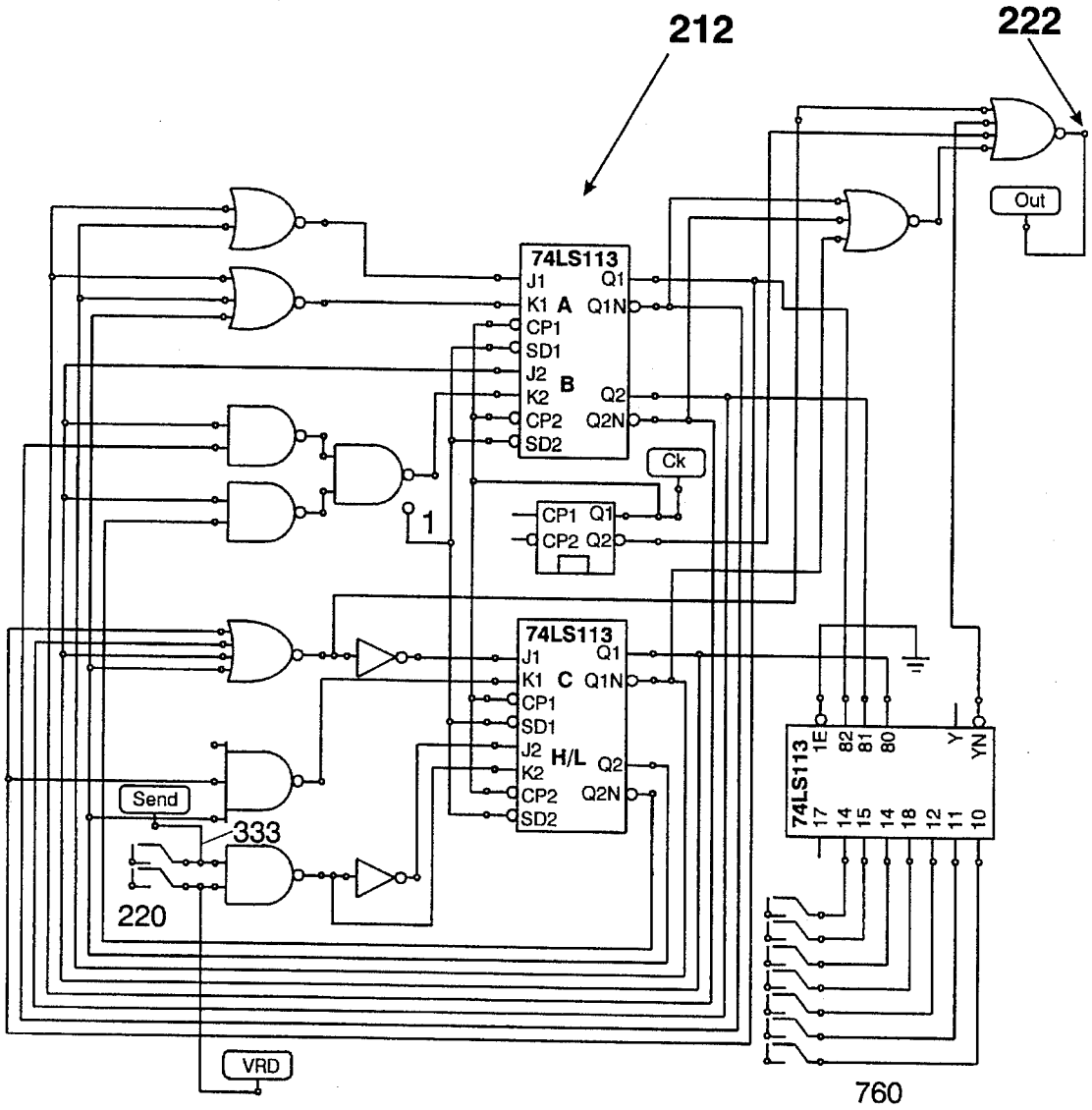

FIG. 5D is a detailed schematic of an exemplary embodiment of the Code Generator Circuit 212 (of FIG. 2B) using NAND-NOR gates, JK flip-flops, and an 8 input multiplexer. When both "Send" (compare SEND, FIG. 2B) and "VRD" (compare 220, FIG. 2B) are high, the Code Generator (212) serially selects and sends each of the seven preset states input to the multiplexer (mux). These signals are synchronized with the leading edge of the circuit's internal clock. The "Out" output is tied to the base (gate, see 222, FIG. 2C) of the SCR 234 of the Code Transmission Circuit.

Figure 5E:
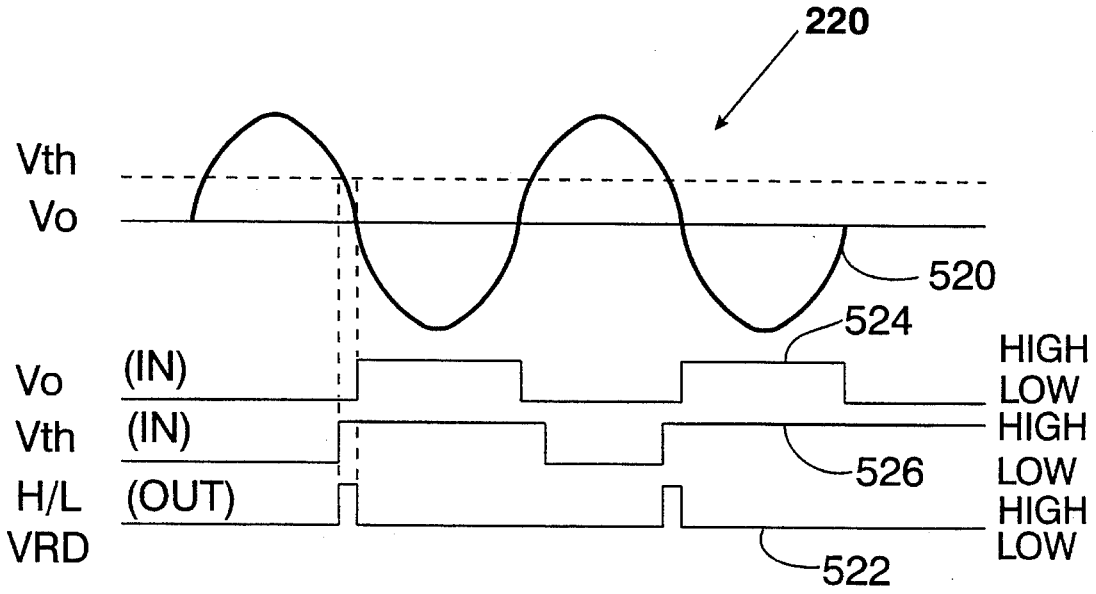
FIG. 5E is a timing diagram of waveforms relevant to the VRD Logic 210 of FIG. 2B, according to the present invention.

FIG. 5E is a timing diagram showing a wave form 520 (sinusoidal) for household voltage, and the generation of a clocking signal 522 (H/L; on the line 220) based on the outputs 524 and 526 of the Vo Sensor (206) and the Vth Sensor (208), respectively. The clocking signal 522 will go high only during the transition from high to low of the sinusoidal voltage wave form in the household power supply. Furthermore, it will stay high only during the time the voltage is between Vth and Vo (between 0 and +5–10 Volts).

Figure 5F:
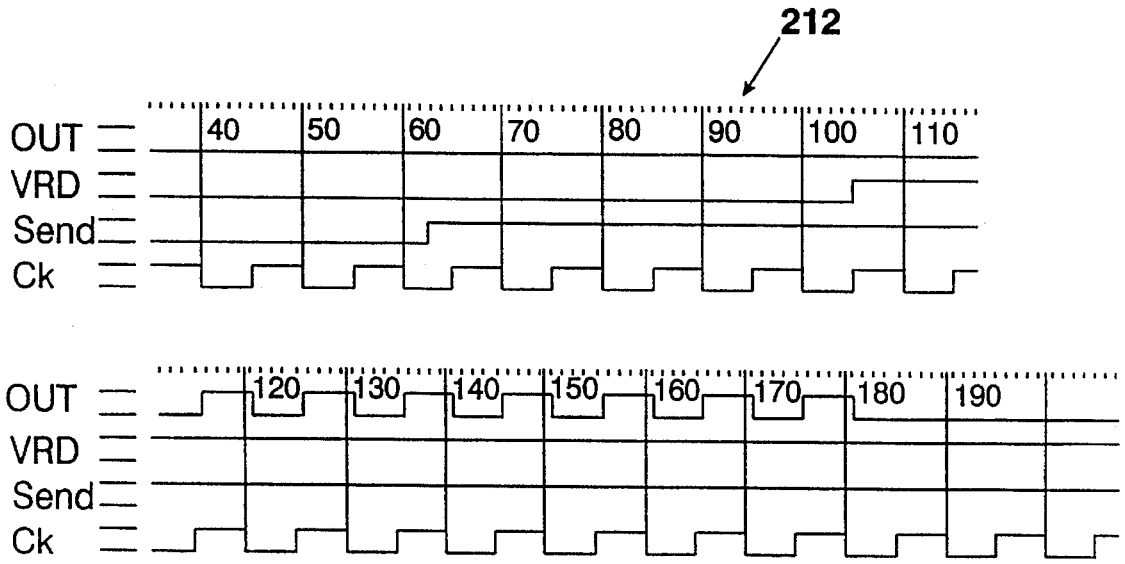
FIG. 5F is a timing diagram of waveforms relevant to the Code Generator 212 of FIG. 2B, according to the present invention.

FIG. 5F is a timing diagram pertaining to an exemplary embodiment of the Code Generator 212 (of FIG. 2B). In this example, the code ("OUT") which is generated and impressed (i.e., the code on the line 222, see FIGS. 2B and 2C) onto the line 214*a* (to become an encoded line 214*c*) is all "ONEs", for illustrative simplicity. Evidently, a less trivial code would be preferred. Time is across the horizontal axis of this diagram.

Figure 6:
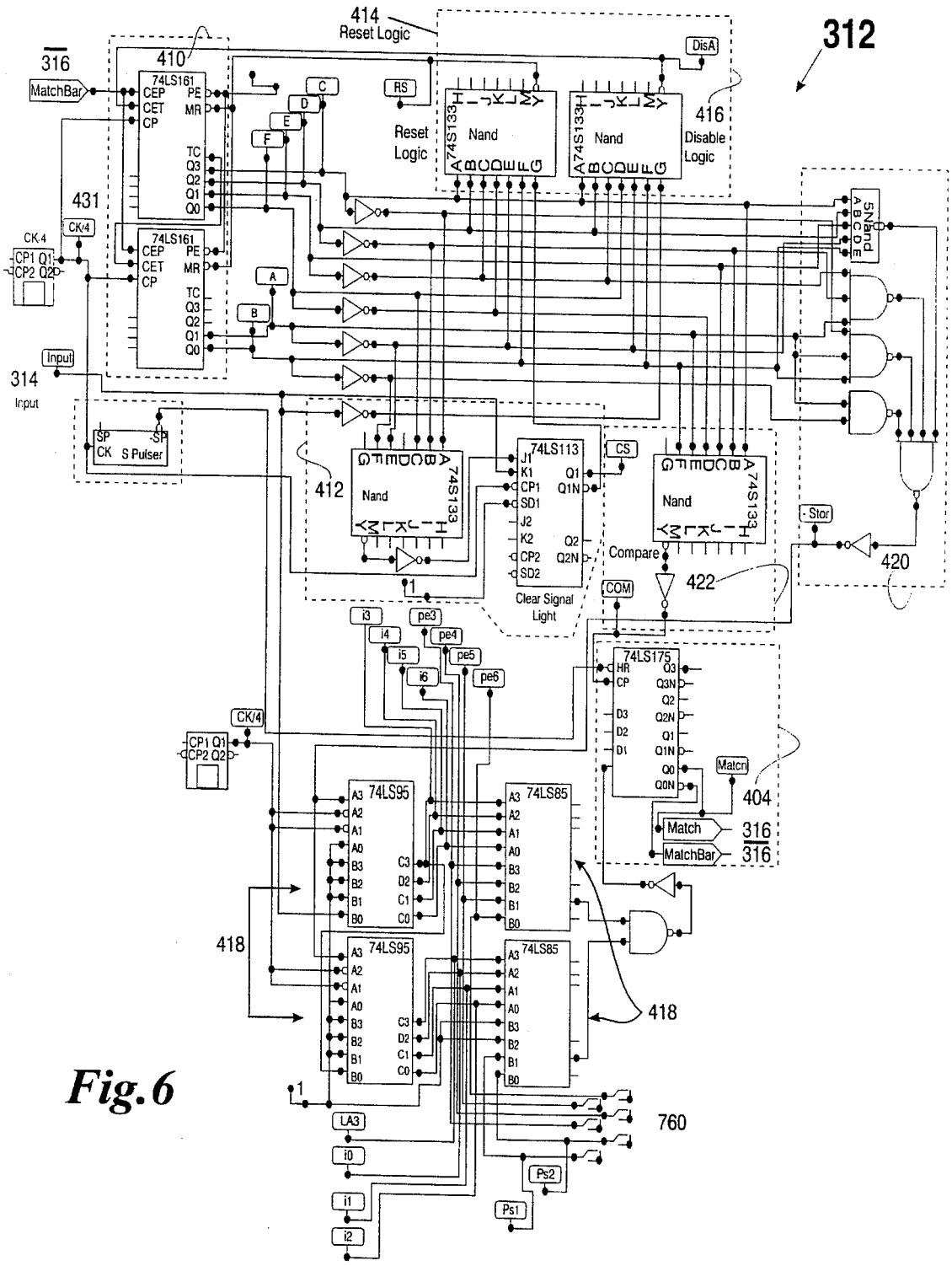
FIG. 6 is a detailed schematic of components of the detector of FIG. 4, according to the present invention.

FIG. 6 is a detailed schematic of an exemplary embodiment of the Counter Controller 312 of FIG. 3C, showing the sub-functions broken out in FIG. 4. Each sub-function corresponds to a block in FIG. 4. The Shift Register and Comparator functions are shown as a single block 418 in FIG. 4, but are somewhat delineated in FIG. 6.

Figure 6A:
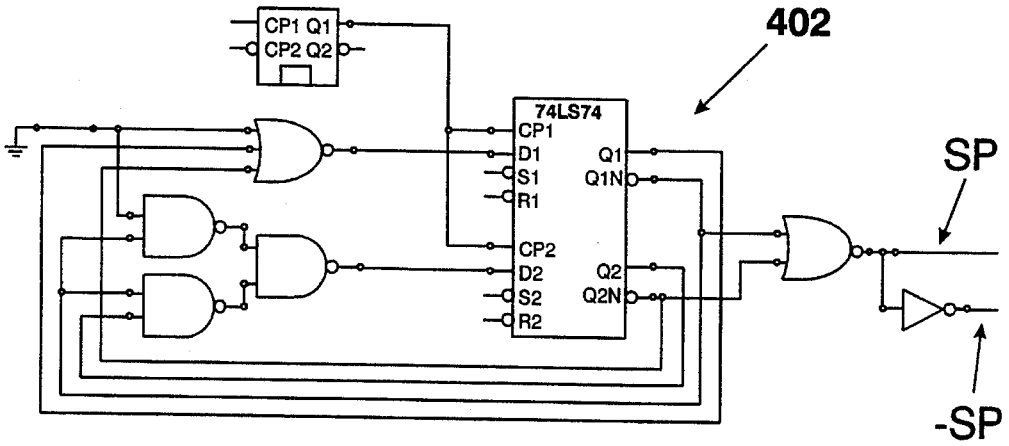
FIGS. 6A and 6B are detailed schematic and timing diagram, respectively for one of the components (Single Pulse Logic 402) of the detector of FIG. 4, according to the present invention.
Figure 6B:
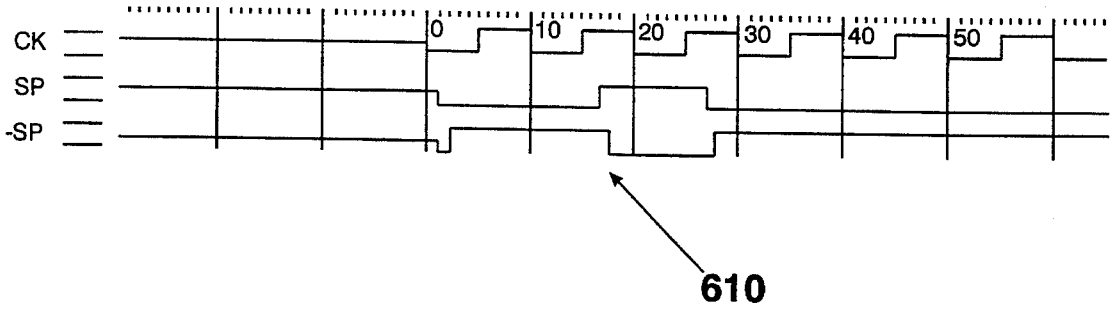

FIG. 6A is a detailed schematic of an exemplary embodiment of the Single Pulser Logic 402 (of FIG. 4), and FIG. 6B is a timing diagram of waveforms within the Single Pulser 402, illustrating the single pulse 610 generated by the Single Pulser 402.

Figure 6C:
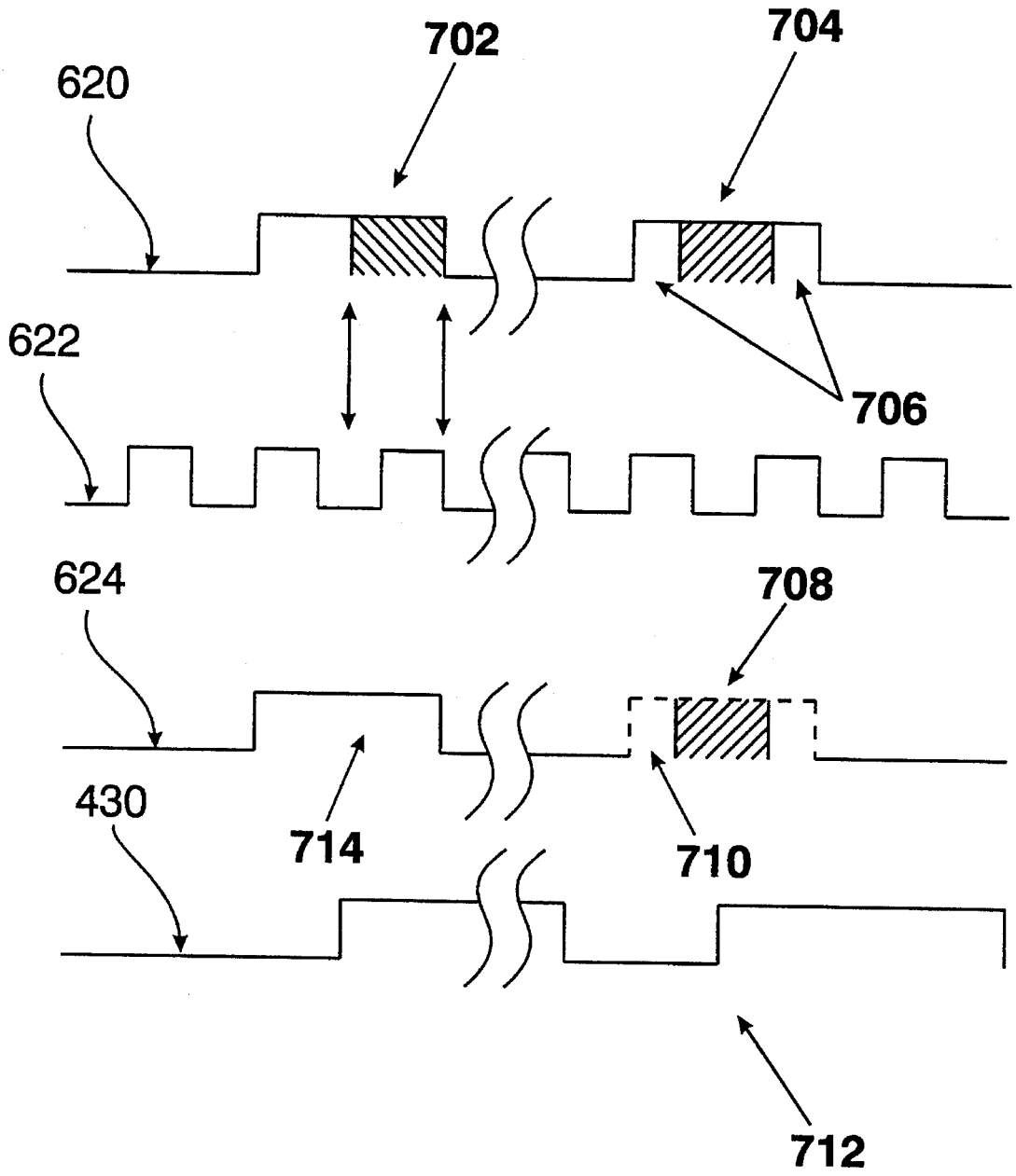
FIG. 6C is a timing diagram of clock rates for the emitter and detector of the present invention.

FIG. 6C is a timing diagram illustrating the relationship of various signals within the detector, according to an exemplary embodiment of the invention. For the four waveforms illustrated, the horizontal axis is the time axis, and is constant.

Trace 620 represents the emitter clock rate. The shaded area in the first (temporally, from left-to-right, as viewed) "window" (or pulse, as established by the sensors 206 and 208) 702 represents an area (time frame) of first detection ("bit 0"). The shaded area in the second window 704 represents an area wherein detection of bits 1–6 occurs. As illustrated, this shaded area is more-or-less centered in the window 704, with "dead zones" 706 on either side thereof, to allow for valid detection of the bits 1–6 in the case where there is some "drift".

Trace 622 represents the detector clock rate, at a second rate which is four times (faster than) the emitter clock rate 620. As mentioned hereinbefore, the shift register (418) is clocked (trace 430, corresponding to "CK" FIG. 4) at a rate which is four times slower than the detector clock rate 622, so that the shift register clock rate is exactly the same as the emitter clock rate 620. However, it will be observed that the shift register clock signal 430 is 90° out-of-phase with the emitter clock signal 620.

Trace 624 represents the code signal. In the first window 714 the signal is shown as having risen, indicating that the leading bit is always "1" (i.e., a logic one). A second window 708, in dashed lines indicating that subsequent bits can be either ones or zeros, is comparable to the window 704, wherein the shaded portion represents an area wherein detection of bits 1–6 occurs.

Trace 430 represents the shift register clock (CK, FIG. 4), which is shown as being exactly four times slower than the detector clock rate to "simulate" the emitter clock rate, as discussed hereinabove. However, as illustrated, the shift register clock signal (430) is out of phase by 90° with respect to the emitter clock signal (620). A window 712 is shown, the leading (to the left, as viewed) edge of which controls detection so that it occurs midway through each subsequent bit (bits 1–6).

SUMMARY OF THE ACHIEVEMENT OF THE OBJECTS OF THE INVENTION

From the foregoing, it is readily apparent that I have invented an improved method and apparatus for providing an improved technique deterring theft of electronic equipment as well as providing a system for securing (deterring theft of) electronic equipment that is suitable to home (versus commercial) use, principally in the low cost and ease of use of such a system. Further, I have provided a technique for protecting electronic equipment against theft, while allowing the authorized user to relocate the electronic equipment as well as provided a technique for protecting electronic equipment that requires little or no effort on the part of the authorized user to restore the functionality of the protected equipment after a power outage.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

For example, one having ordinary skill in the art to which the invention most nearly pertains will recognize, in light of the teachings of the present invention, that:

(a) the signal on one "branch" of three-phase (240 V) household wiring (e.g., on one line of two conductors) can be "bridged" onto another branch with a suitable bridge circuit;

(b) in order to prevent a signal from propagating to a neighbor's house (e.g., any house on the same side of the utility company transformer), a "trap" can be installed between the power meter and the fuse box; and (c) although the invention has been described in the context of "home" electronic appliances, it has equal utility for small businesses and the like.

A notable difference between the present invention and a device such as a common garage door opener is that the code in the decoder is not readily changed by an unauthorized user. Rather, the decoder is designed to lock onto a unique code provided by a uniquely-coded encoder, and trial-and-error techniques of activating the protected device with a "generic" encoder would be futile. Garage door openers are typically provided with dip switches, in both the transmitter and in the receiver, for the user to personalize the code, and a thief having easy access to the dip switches in the opening mechanism could match the code set therein in a generic transmitter. Inasmuch as a garage door opening mechanism is not readily unplugged and stolen, it is not considered to be a piece of "portable" electronic equipment, as contemplated by the present invention.

What is claimed is:

1. Method of protecting portable electronic equipment against unauthorized power-up, said electronic equipment deriving its power from household-type wiring and having a power supply component, comprising:

providing the power supply component of the electronic equipment with a decoder, said decoder permitting powering-up the electronic equipment only upon receipt of an externally-generated unique code; and connecting an encoder-emitter to the household-type wiring for transmitting the unique code to the decoder;

wherein:

the decoder permits repeated powering-up of the electronic equipment so long as the decoder remains connected to the household-type wiring; and the decoder prohibits subsequent powering-up of the electronic equipment in the event that the household-type wiring discontinues to deliver power to the electronic equipment or in the event that the decoder is disconnected from the household-type wiring.

2. Method, according to claim 1, wherein:

the electronic equipment derives its power from a selected household-type power wiring; and further comprising:

hard-wiring the encoder into the selected household-type power wiring.

3. Method, according to claim 1, wherein:

the unique code is internal to the encoder.

4. Method, according to claim 1, further comprising:

supplying the unique code to the encoder with a key that is external to the encoder.

5. Method, according to claim 1, wherein:

the encoder is readily transported by an authorized user to be plugged into the same power wiring to which the electronic equipment is connected to derive its power.

6. Method, according to claim 1, wherein:

the encoder transmits the unique code to the decoder via a short range RF signal.

7. Method, according to claim 1, wherein: the encoder is located off-site, and the unique code is unique to the site.

8. Method, according to claim 1, further comprising:

providing a plurality of items of electronic equipment with a corresponding plurality of decoders, all of the decoders responding to a single unique code; and causing all of the items of electronic equipment to be power-uppable with a single encoder providing the single unique code.

9. Method, according to claim 1, further comprising:

clocking the encoder at a first rate; and clocking the decoder at a second rate which is at least two times faster than the first rate.

10. Method, according to claim 9, further comprising:

clocking the encoder at a first rate; and clocking the decoder at a second rate which is at least four times faster than the first rate.

11. Method, according to claim 1, further comprising:

marking the electronic equipment to visually indicate that its power supply is equipped with a decoder.

12. Method, according to claim 1, wherein transmission of the unique code is performed during quiet times.

13. Method, according to claim 1, wherein enabling and disabling electronic equipment to power up is accomplished through inserting a power key into a wall socket.

14. Method of providing security for portable electronic equipment comprising:

providing a unique predetermined multi-digit security code selectively upon power up;

providing electronic equipment with a detector, said detector permitting the electronic equipment to be powered up only if the unique code is received; and providing an emitter for externally transmitting the unique code to the detector.

15. Method, according to claim 14, wherein: the electronic equipment is connected to household-type wiring for its power; and further comprising:

transmitting the unique code over the household wiring.

16. Method, according to claim 14, wherein said unique predetermined multi-digit security code has a leading bit of 1 and subsequent bits of either 1 or 0.

17. An anti-theft device for protecting portable electronic equipment comprising:

an automatic unique predetermined multi-digit first security code;

send means operably associated with a transmitter means;

first memory means for storing said first code;

transmitter means, connected to said first memory means, for communicating said first code to said electronic equipment;

receiver means, disposed within said electronic equipment, for receiving said first code transmitted from said transmitter means;

second memory means, connected to said receiver means, for storing a second code;

circuitry, connected to said second memory means and to said receiver, for comparing said second code with said received first code; and circuitry for enabling the powering up of said electronic equipment only when said circuitry for comparing determines that said second code matches said first code.

18. An anti-theft device, as claimed in claim 17, wherein:

said receiver means further includes means for switching the electronic equipment to an external power source in response to the second code's matching the first code.

19. An anti-theft device, as claimed in claim 17, wherein:

said electronic equipment derives its power from power lines; and further comprising:

transmitting said first code over said power lines.

20. An anti-theft device, as claimed in claim 19, wherein the transmitter means further comprises:

a first voltage sensing circuit connected to said power lines, said first voltage sensing circuit producing a first signal when a voltage in said power lines equals zero (0) volts;

a second voltage sensing circuit connected to said power lines, said second voltage sensing circuit producing a second signal when said voltage in said power lines equals 5–10 volts;

a voltage range detector connected to receive the first and the second signals, and providing a third signal controlling operation of a code generator which stores the unique code and which provides the unique code to a code transmission circuit in response to the third signal for impressing the unique code on the power lines.

21. An anti-theft device, as claimed in 17, wherein the receiver further comprises:

clean signal logic for disabling the receiver means when the power lines are noisy.

22. An anti-theft device, as claimed in claim 17, further comprising:

means for clocking the receiver means at at least twice a rate of the transmitter means.

23. An anti-theft device, as claimed in claims 22, further comprising:

means for clocking the receiver means at at least four times the rate of the transmitter means.

24. An anti-theft device, as claimed in claim 17, further comprising:

means for synchronizing communication of the unique code between the transmitter means and the receiver means.

25. An anti-theft device, as claimed in claim 24, wherein the means for synchronizing comprises:

means for establishing a first time frame wherein a first bit of the first code is transmitted, and for establishing a second time frame following the first time frame wherein subsequent bits of the first code are detected.

26. An anti-theft device, as claimed in claim 25, further comprising:

means for detecting the subsequent bits midway through each subsequent time frame.

27. An anti-theft device, as claimed in claim 17, wherein:

said first code is communicated automatically by the transmitter means to the receiver means, without user intervention.

28. An anti-theft device, as claimed in claim 27, wherein:

once the transmitter means is connected to power lines supplying power to the receiver means, said first code is communicated automatically by the transmitter means to the receiver means, whenever there is power on the power line.

29. An anti-theft device, as claimed in claim 17, wherein:

the transmitter means is plugged into household-type wiring from which the receiver means derives operating power.

30. An anti-theft device, as claimed in claim 17, wherein:

the transmitter means is hard-wired to household-type wiring from which the receiver means derives operating power.

31. An anti-theft device, according to claim 17, further comprising:

a power key, insertable into the transmitter means, for providing the first code to the first memory means.

32. An anti-theft device, according to claim 31, wherein:

the transmitter means is hard-wired to said electronic equipment.

33. An anti-theft device, according to claim 17, wherein:

the transmitter means is plugged into said electronic equipment.

34. An anti-theft device, as claimed in claim 17, further comprising means for transmission of said automatic unique predetermined multi-digit first security code during quiet times.

* * * * *